US006343455B2

(12) United States Patent
Bois

(10) Patent No.: US 6,343,455 B2
(45) Date of Patent: Feb. 5, 2002

(54) METHOD AND APPARATUS FOR MANUFACTURING PACKAGING BAGS, AND BAGS OBTAINED THEREBY

(75) Inventor: Georges Henri Bois, Neuilly-sur-Seine (FR)

(73) Assignee: Flexico-France, Henonville (FR)

( * ) Notice: Subject to any disclaimer, the term of this patent is extended or adjusted under 35 U.S.C. 154(b) by 0 days.

(21) Appl. No.: 09/871,613

(22) Filed: Jun. 4, 2001

Related U.S. Application Data

(62) Division of application No. 09/155,422, filed as application No. PCT/FR98/00138 on Jan. 29, 1998.

(30) Foreign Application Priority Data

Jan. 29, 1997 (FR) ..... 97 00936

(51) Int. Cl.[7] ..... B65B 9/20

(52) U.S. Cl. ..... 53/128.1; 53/141; 53/389.3; 53/551

(58) Field of Search ..... 53/451, 459, 141, 53/389.3, 552, 410, 128.1; 493/231, 243

(56) References Cited

U.S. PATENT DOCUMENTS

| | | | | |
|---|---|---|---|---|
| 3,980,225 | A | * | 9/1976 | Kan |
| 4,228,728 | A | * | 10/1980 | Hollis |
| 4,617,683 | A | * | 10/1986 | Christoff |
| 4,655,862 | A | * | 4/1987 | Christoff et al. |
| 4,666,536 | A | * | 5/1987 | Van Erden et al. |
| 4,701,361 | A | * | 10/1987 | Van Erden |
| 4,709,398 | A | * | 11/1987 | Ausnit |
| 4,736,450 | A | * | 4/1988 | Van Erden et al. |
| 4,844,759 | A | * | 7/1989 | Boeckman |
| 4,878,987 | A | * | 11/1989 | Ven Erden |
| 4,909,017 | A | * | 3/1990 | McMahon |
| 4,929,225 | A | * | 5/1990 | Ausnit et al. |
| 5,111,643 | A | | 5/1992 | Hobock |
| 5,788,378 | A | * | 8/1998 | Thomas |

FOREIGN PATENT DOCUMENTS

| | | | | |
|---|---|---|---|---|
| DE | 3824753 | | | 9/1989 |
| DE | 3824753 | A1 | * | 9/1989 |
| JP | 4-6049 | | | 1/1992 |
| JP | 404006049 | A | * | 6/1992 |
| JP | 5-97151 | | | 4/1993 |
| JP | 405097151 | A | * | 4/1993 |
| JP | 7-214702 | | * | 7/1995 |
| JP | 7-214702 | | | 8/1995 |

* cited by examiner

*Primary Examiner*—John Sipos
(74) *Attorney, Agent, or Firm*—Schwartz & Weinrieb

(57) ABSTRACT

The present invention relates to a method of manufacturing packaging bags having lateral bellows, the method being characterized by the fact that it comprises the steps consisting in: forming respective cutouts (150, 160) in each of the two lateral, bellows-forming zones of a packaging bag sheet (100) so that the bag has only two thicknesses superposed at the mouth of said bellows, at least over a portion of its width; and heat-sealing (184, 186) the adjacent edges of the sheet to the peripheries of the cutouts (150, 160) to close the bag. The invention also provides apparatus for implementing the method and bags obtained thereby.

22 Claims, 5 Drawing Sheets

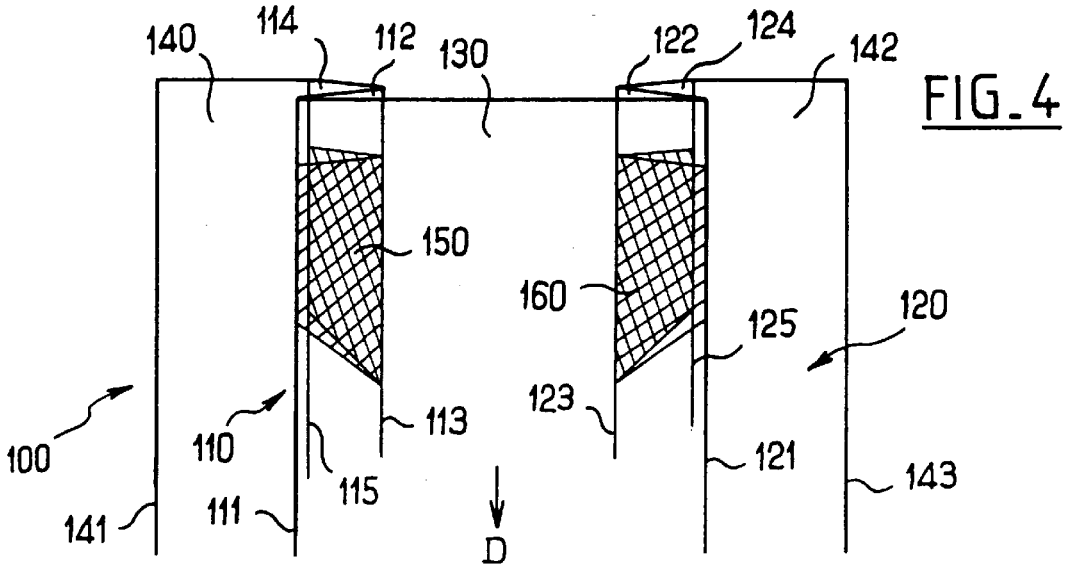
FIG. 4
FIG. 5
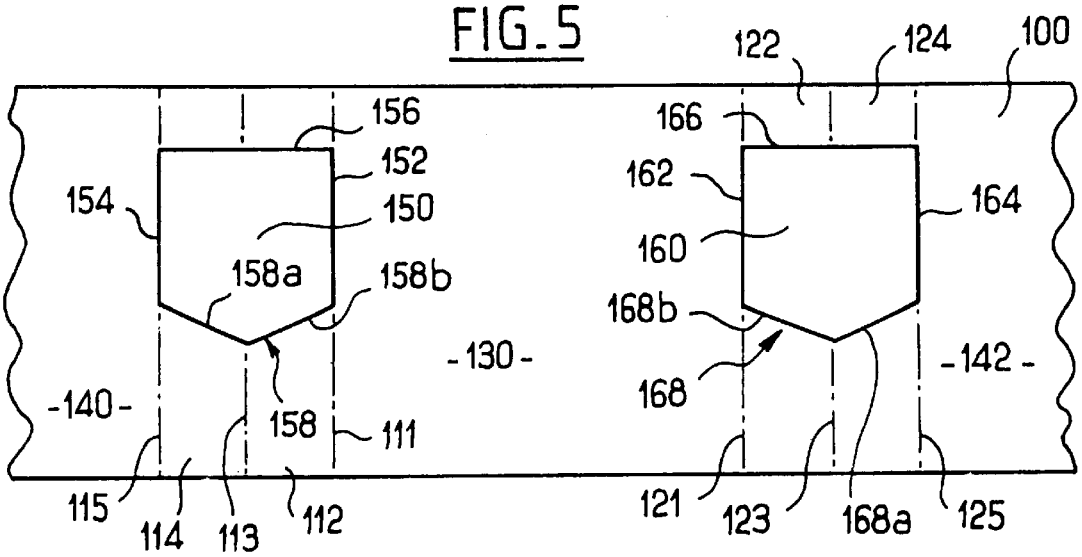
FIG. 5a
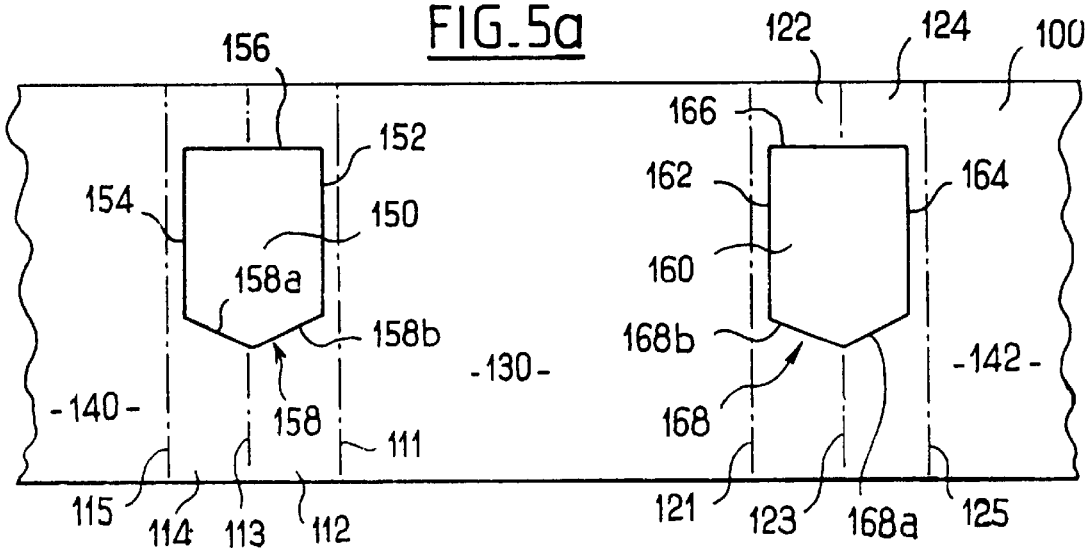

METHOD AND APPARATUS FOR MANUFACTURING PACKAGING BAGS, AND BAGS OBTAINED THEREBY

This patent application is a Divisional patent application of prior U.S. patent application Ser. No. 09/155,422, which was filed on Sep. 29, 1998, which is the U.S. national stage of PCT/FR/98/00138, filed Jan. 29, 1998.

FIELD OF THE INVENTION

The present invention relates generally to the field of packaging bags, and more particularly, to a new and improved method of manufacturing packaging bags.

BACKGROUND OF THE INVENTION

Numerous packaging bags and numerous systems for manufacturing them have already been proposed.

For bags of small thickness, i.e. that are generally flat in the filled state, known means generally give satisfaction. Under such circumstances, the bags are generally formed using two plane sheets that are bonded together along three sides and that are provided with closure means, e.g. complementary male/female strips, at the mouth of a bag.

In contrast, until now, making bags that are intended to receive contents that are thick, has turned out not to be entirely satisfactory, even though a large amount of research has been performed in this very specific field.

In particular, such bags often require lateral bellows which are difficult to make.

Accompanying FIG. 1 shows, diagrammatically, a known technique for making bags with lateral bellows by inserting pre-formed bellows 10 between two sheets 12 and 14 that constitute two main faces of the bags, with the bellows being inserted at 90° to the travel direction S of said sheets. Said sheets 12 and 14 are provided with longitudinal male/female closure strips 13 and 15. The bellows 10 are preferably of varying width, increasing away from the closure strips 13 and 15 so as to enable the bags to be inflated. That known technique does indeed make it possible to make packaging bags having lateral bellows. Nevertheless, it turns out to be quite complex. In particular, the need to insert the bellows 10 at 90° to the travel direction of the sheets 12 and 14 does not enable high manufacturing throughputs to be obtained, and requires insertion of the bellows 10 to be adequately synchronized with the travel of the sheets 12 and 14.

Document FR-A-2 686 063 describes another technique of manufacturing packaging bags with bellows that consist in preforming a bag with lateral bellows, in splitting the bag over a portion of its length along fold lines external to the bellows, in folding the flaps defined in this way back over the outside of the bag, in placing the closure strips on said flaps, in reforming the bag, and in bonding the closure strips to said flaps that have been put into place. Unfortunately, because of its complexity, that technique does not give full satisfaction.

The Applicant has also described various alternative solutions for manufacturing packaging bags with lateral bellows in French patent application No. 96 02389 filed on Feb. 27, 1996.

OBJECT OF THE INVENTION

The present invention seeks to improve upon the known means for manufacturing packaging bags having lateral bellows.

SUMMARY OF THE INVENTION

The aforenoted object is achieved in the context of the present invention by a method of manufacturing packaging bags characterized by the fact that it comprises the steps of:

forming respective cutouts in each of the two lateral, bellows-forming zones of a packaging bag sheet so that the bag has only two thicknesses superposed at the mouth of said bellows, at least over a portion of its width; and heat-sealing the adjacent edges of the sheet to the peripheries of the cutouts to close the bag.

The present invention also provides apparatus for implementing the method, and bags obtained thereby.

BRIEF DESCRIPTION OF THE DRAWINGS

Various other objects, features, and attendant advantages of the present invention will be more fully appreciated from the following detailed description when considered in connection with the accompanying drawings in which like reference characters designate like or corresponding parts throughout the several views, and wherein:

FIG. 4 is a view similar to FIG. 2 and shows the portion of film that is removed to form cutouts;

FIG. 5 shows the same film as provided with cutouts, when spread out flat;

FIG. 5*a* is a view similar to that of FIG. 5 showing a variant film of the present invention that is also provided with cutouts;

DETAILED DESCRIPTION OF THE ILLUSTRATED EMBODIMENTS

Figure 1:
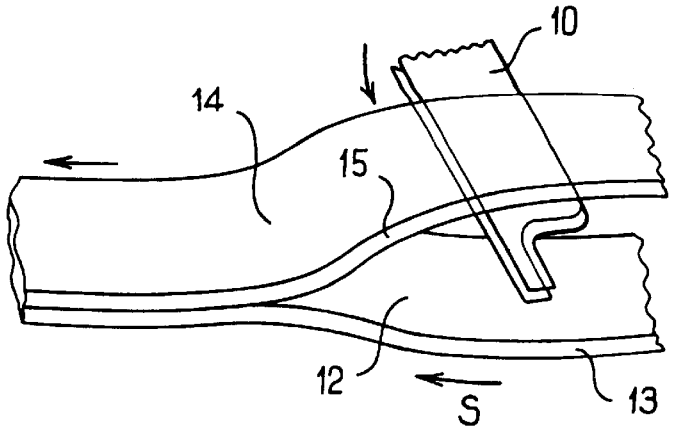
FIG 1 (PRIOR ART)
FIG. 1, described above, is a diagram showing a conventional technique of manufacturing packaging bags having lateral bellows.
Figure 2:
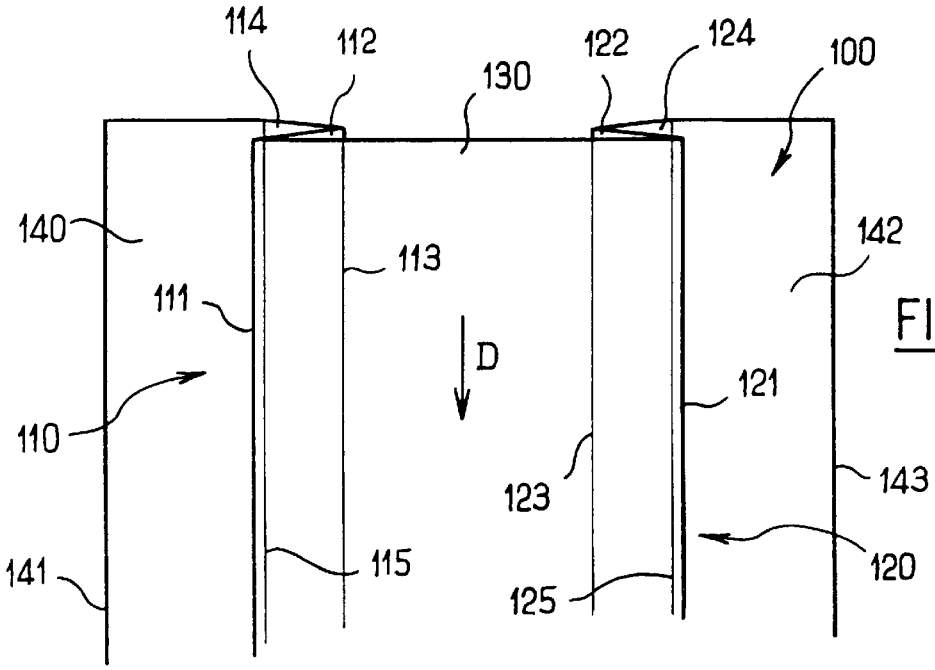
FIG. 2 shows a first step of a method of the present invention consisting in forming two Z-folds in a film.

In FIG. 2, there can be seen a film 100 which is provided with two Z-folds 110 and 120 that are parallel to the longitudinal direction D of the film 100.

The two Z-folds 110 and 120 can be formed by any appropriate means.

Figure 3:
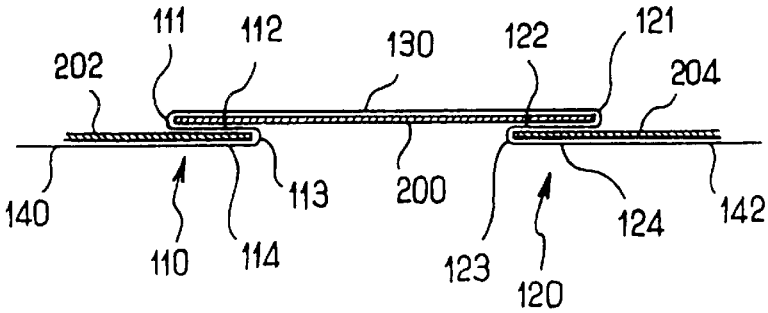
FIG. 3 is a cross-section view through the same film.

Each of them is preferably formed by means of two blades 200,202 or 200,204 that are superposed in a partially overlapped manner with respect to each other, as shown in FIG. 3, so as to form a baffle into which the film 100 is engaged.

The folds 110 and 120 are designed to form the lateral bellows of the bag once it has been completed.

After the folds 110 and 120 have been made, the film as shown in FIG. 2 has a plane main face 130 that is to form a main face of the bag after it has been completed. On its longitudinal edges, this main face 130 is extended on either side by first longitudinal flaps 112 and 122 which are themselves extended by second longitudinal flaps 114 and 124. The flaps 112 and 114 form the fold 110. The flaps 112 and 114 form the fold 120. The flaps 112 and 122 are connected to the main face 130 via fold lines 111 and 121. The flaps 112 and 122 are folded towards the middle of the face 130 from the fold lines 111 and 121 so that they underlie the main face 130. The flaps 114 and 124 are connected to the flaps 112 and 122 via fold lines 113 and 123. The flaps 114 and 124 extend outwards from the fold lines 113 and 123. The flaps 114 and 124 are also of the same length as the flaps 112 and 122 so as to underlie them respectively, being immediately beneath them. Finally, each of the flaps 114 and 124 is extended outwards by auxiliary segments 140 and 142. These auxiliary segments 140 and 142 are designed, in combination, to form the second main face of the bags. As shown in FIG. 2, the two segments 140 and 142 are preferably of identical width. Nevertheless, this condition is not essential. What is essential is that the segments 140 and 142 possess a total width that is slightly greater than the width of the face 130 so as to form the second face of the bags after they have been folded about their outer longitudinal free edges, as explained below with reference to FIG. 8.

After the step of forming the folds 110 and 120 as shown in FIG. 2, the flaps 114 and 124 are substantially coplanar with the segments 140 and 142. The flaps 114 and 124 are connected to the segments 140 and 142 via lines 115 and 125.

As mentioned above, according to an essential characteristic of the present invention, the method of forming a bag includes a step of cutting out pairs of cutouts 150 and 160 at regular intervals in each of the zones that is to form a lateral bellows.

The areas of material removed to form these cutouts 150 and 160 are shaded in FIG. 4.

The cutouts 150 and 160 are shown in the deployed state in FIG. 5.

Figure 6:
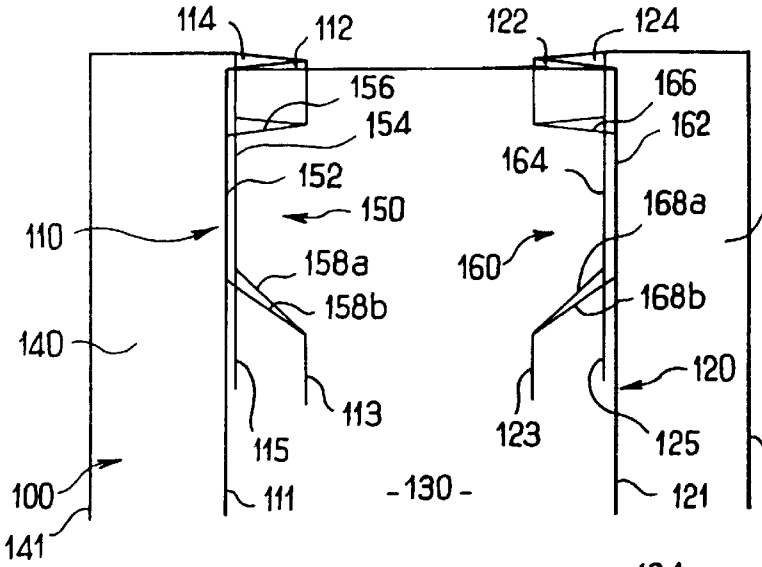

Finally, the cutouts 150 and 160 are shown in their real configuration within the folds 110 and 120 in FIG. 6.

Figure 10:
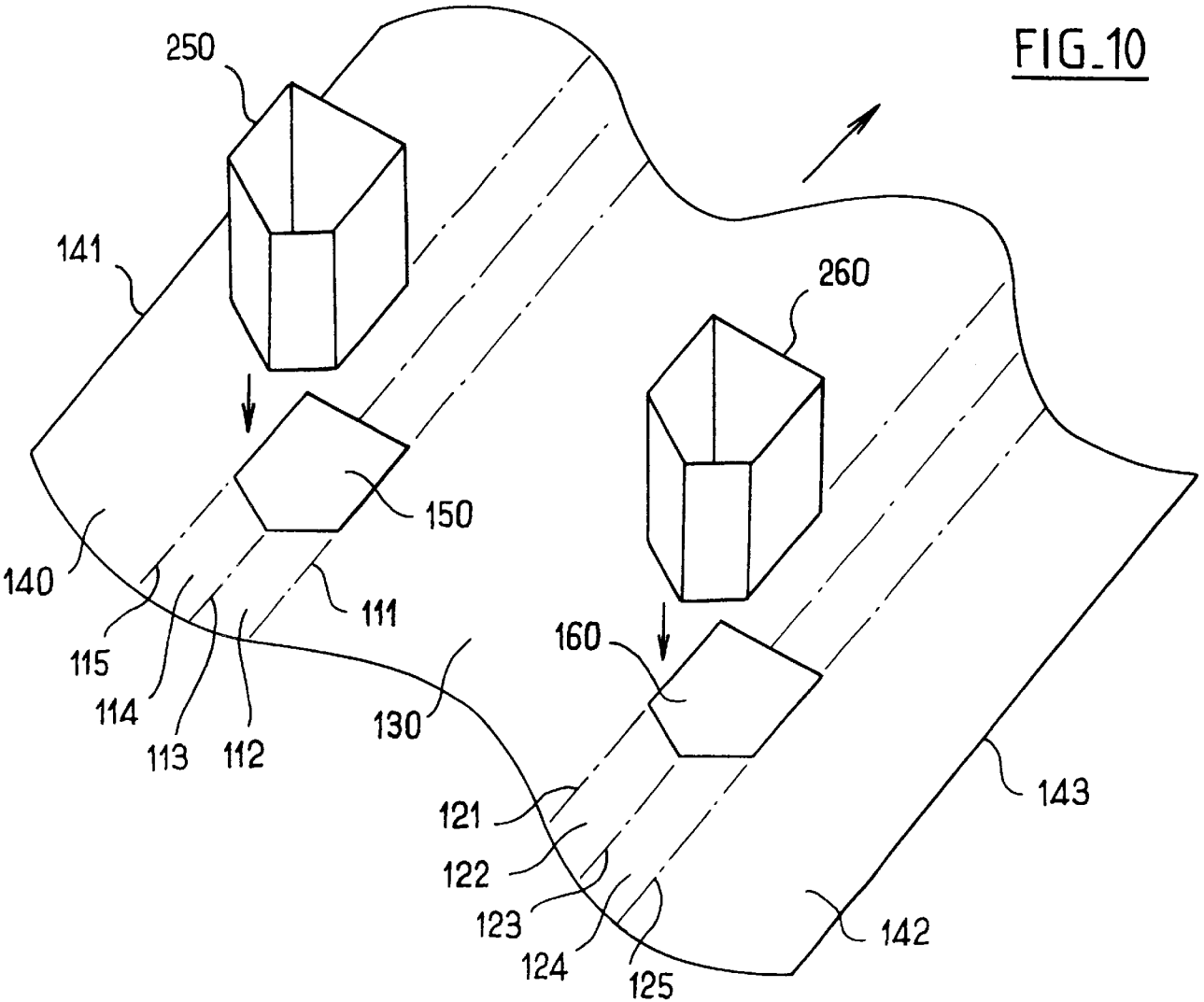
FIG. 10 is a perspective view of a first embodiment of a die for forming the cutouts within the bag material when the bag material is disposed in its unfolded state.

The cutouts 150 and 160 can be formed in the film 100 before making the folds 110 and 120. Under such circumstances, their initial shape is as shown in FIG. 5. In particular, such cutouts 150 and 160 can be formed utilizing the dies 250 and 260 as illustrated in FIG. 10.

Figure 11:
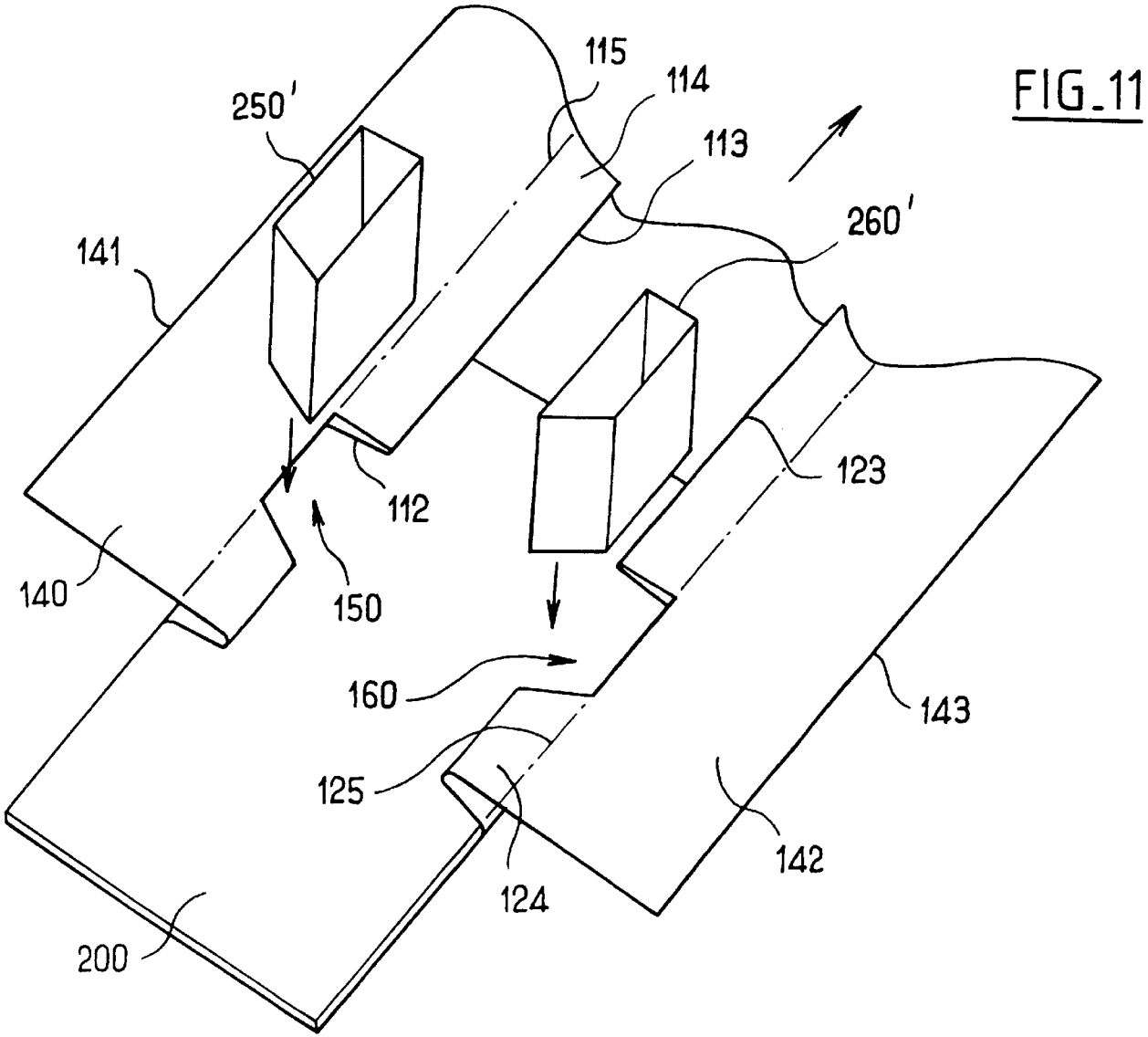
FIG. 11 is a perspective view similar to that of FIG. 10 showing a second embodiment of a die for forming the cutouts within the bag material when the bag material is disposed in its folded state.

Nevertheless, it is preferable for the cutouts 150 and 160 to be formed after the folds 110 and 120 have been made. The cutouts 150 and 160 can be made in the film 100 by any appropriate means. The cutouts 150 and 160 are preferably made using the blade 200 as an anvil that co-operates with a cutting-out punch so as to leave the face 130 of the film intact. More particularly, such cutouts 150 and 160 can be formed utilizing the dies 250' and 260' as illustrated in FIG. 11.

The shapes of the cutouts 150 and 160 can vary in numerous ways.

The cutouts 150 and 160 preferably extend between the lines 111 and 115 on one side and the lines 121 and 125 on the other side, as shown in FIG. 5. Nevertheless, in a variant, as shown in FIG. 5*a,* the cutouts 150 and 160 can be formed so as to be set back from the above-mentioned lines 111 and 115, and 121 and 125, as shown in FIG. 5*a.*

More precisely, and as shown in FIGS. 5 and 5*a,* each of the cutouts 150 and 160 is defined by two longitudinal edges 152,154 and 162,164, and by two transverse edges 156,158 and 166,168.

The longitudinal edges 152,154 and 162,164 are rectilinear and coincide respectively with the lines 111, 115,121, and 125 in FIG. 5, which lines themselves constitute the final outer generator lines of the lateral bellows. In the folded state as shown in FIG. 6, the pair of edges 152,154 or 162,164 are superposed.

The transverse edges 156 and 166 that are closer to the mouth of a bag are preferably rectilinear, extending transversely relative to the longitudinal direction D of the film 100.

The second transverse edges 158 and 168 that are closer to the bottom of a bag are preferably not rectilinear, but are concave towards the mouth of the bag. More precisely, the second transverse edges 158 and 168 are preferably in the form of a dihedral made up of two rectilinear segments 158*a* and 158*b,* or 168*a* and 168*b.* The above-mentioned pairs of segments 158*a* and 158*b,* and 168*a* and 168*b,* constituting respective second transverse edges 158 and 168 are preferably identical in length. They extend respectively over the flaps 112 and 114, and 122 and 124. In this manner, the segments 158*a* and 158*b,* and 168*a* and 168*b,* intersect on the middle fold lines 113 and 123.

As a non-limiting example, the segments 158*a* and 158*b,* and 168*a* and 168*b,* are inclined approximately 15° relative to a line extending transversely to the longitudinal direction D, such that the dihedral angle formed between the pairs of segments 158*a* and 158*b,* and 168*a* and 168*b,* is approximately 150°.

The generally planar film 100 together with its two Z-folds 110 and 120 and provided with its two cutouts 150 and 160 as shown in FIGS. 5 and 5*a* is preferably fed directly to a conventional form, fill, and seal machine for making packaging bags.

Such machines are often referred to as "FFS" machines, from the initials of the term "form, fill, and seal".

Numerous machines of this type have already been proposed.

Most such machines have: a forming throat which has an input receiving the film in the flat state and which has an output delivering the film shaped into a tube; a filling chute which opens out into the forming throat and consequently into said tube; longitudinal heat-sealing means for closing the tube longitudinally; and means suitable for acting sequentially to generate a first transverse line of heat-sealing before substance is inserted into the tube via the filling chute, and then a second transverse line of heat-sealing once the substance has been inserted into the tube, so as to close the bag around the substance.

The general structure of such machines is well known to the person skilled in the art, so the structure is not described in detail below.

Figure 7:
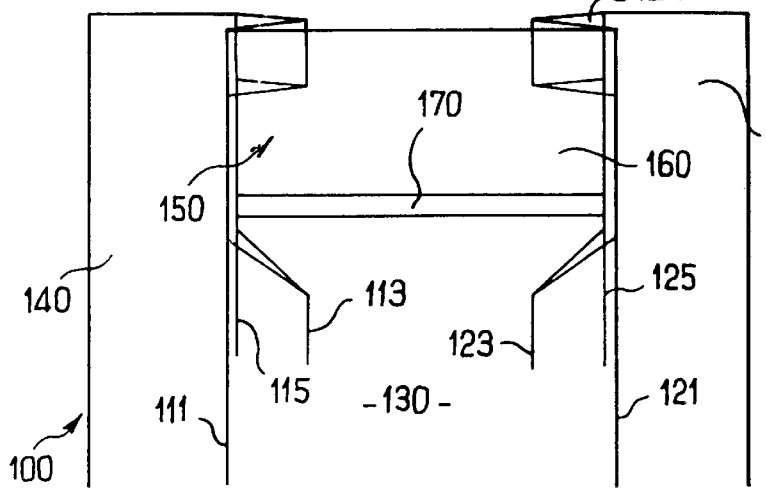

It will be observed that in the context of the present invention, it is preferable for complementary male/female closure strips 170 to be deposited on the film 100 in the vicinity of the mouth zone of a bag transversely to the longitudinal direction D, and prior to the film 100 being brought to the forming throat of the FFS machine, as shown in FIG. 7.

Still more precisely, closure strips 170 are placed against the main face 130 facing the cutouts 150 and 160, i.e. between the transverse edges 156 and 158 at one end and 166 and 168 at the other.

The closure strips 170 are preferably of a length that is equal to the width of the main face 130, i.e. the distance between the fold lines 111 and 121.

After being placed on the film 100, the strips 170 are secured in position on the film 100 by any appropriate means. Preferably, after they have been put into place, the strips 170 are initially fixed to the film 100 solely via their ends using a spot heat-sealing technique. The strips 170 are subsequently fixed to the main faces of the bag over the full length of their inside faces, preferably when making the transverse lines of heat-sealing in the manner described below with reference to FIG. 9. When the strips 170 are secured by spot heat-sealing at their ends, the lateral edges of the bag facing the folds 110, 120 can also be secured by spot heat-sealing at the zones where the transverse lines of heat-sealing shown in FIG. 9 will subsequently be made for holding the above-mentioned folds together and preventing them from deforming as the film 100 moves on.

Nevertheless, in a variant, at least one of the strips 170 may be heat-sealed to the film 100 along its entire length as soon as it is put into place.

The above-mentioned means for spot heat-sealing are preferably adjustable along the length of the film 100 so as to make it possible for them to be adjusted accurately relative to the desired length for the bags and to the zones that will subsequently correspond to the transverse lines of heat-sealing.

Naturally, it is also necessary to synchronize carefully the instant at which said spot heat-sealing means are operated relative to the travel of the film 100, since the instants at which said spot heat-sealing means operate determine both the locations of the corresponding heat-sealing zones and the pitch of said zones.

Figure 9:
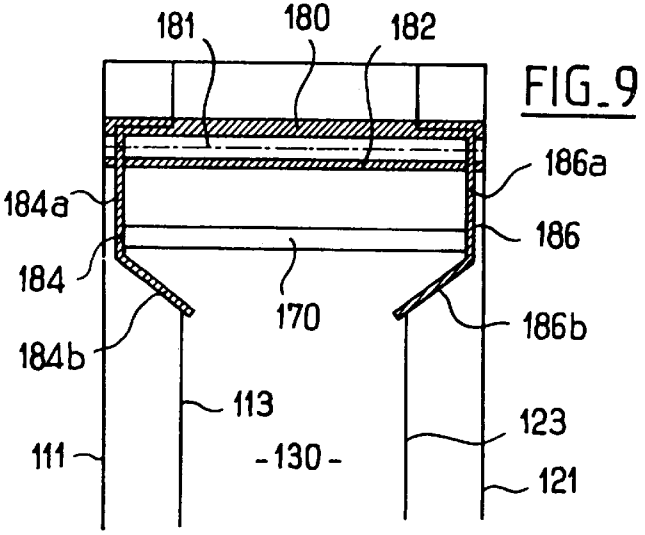

By fixing the closure strips 170 via their ends, and possibly also by fixing the folds 110 and 120 by spot heat-sealing, subsequent travel of the film 100 is made easier and it is also easier subsequently to perform the heat-sealing as shown in FIG. 9, particularly because of the resulting crushing of the ends of the strips 170.

The means for making the above-mentioned spots of heat-sealing can be generally like the means described in document FR-A-2 638 419.

In a variant, the closure strips 170 are fixed, and the folds 110 and 120 are held temporarily by spots that are not made by heat-sealing, but are made by any equivalent means, such as by static discharge or by spots of adhesive.

The means designed for depositing the closure strips 170 on the film 100 so that they extend transversely to the longitudinal direction D of the film 100 can be implemented in numerous ways.

By way of non-limiting examples, these means may be like the means described in the following documents: U.S. Pat. Nos. 4,617,683, 4,655,862, 4,666,536, 4,701,361, 4,709,398, 4,878,987, 4,844,759, 4,929,225, 4,909,017, and 5,111,643.

Once the folds 110 and 120 have been made and the closure strips 170 have been put into place and secured, at least temporarily, the film assembly 100 as shown in FIG. 7 is sent to the forming throat of an FFS machine, as mentioned above.

Where appropriate, special means may be provided at the forming throat to facilitate passage thereover, in particular of the folds 110, 120. By way of example, complementary windows may be provided on the forming throat to receive the folds 110 and 120.

Figure 8:
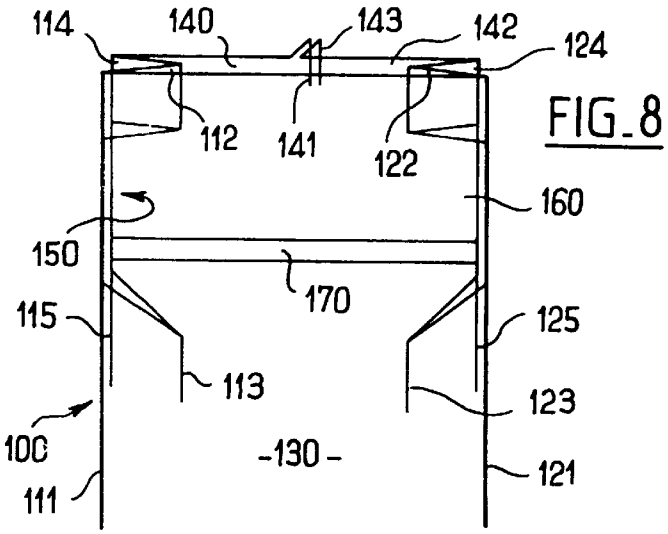
FIGS. 6 to 9 show four successive steps of the method of the present invention for forming bags.

On leaving the forming throat, the film 100 is shaped into a tubular state, as shown in FIG. 8. The outer free edges 141 and 143 of the segments 140 and 142 are then brought together and heat-sealed in conventional manner by the above-mentioned longitudinal heat-sealing means of the FFS machine.

The tubular film is then filled with its content via the filling chute provided for this purpose.

The tubular film is then brought to face the heat-sealing means provided for making the lines of heat-sealing shown in FIG. 9.

The following are then preferably provided at these heat-sealing means:

- two mutually parallel lines of heat-sealing 180 and 182; and
- respective lines of heat-sealing 184 and 186 at the peripheries of the cutouts 150 and 160.

One of the transverse lines of heat-sealing 180 coincides with the transverse edges 156 and 166 of the cutouts. This transverse line of heat-sealing 180 is designed to form the bottom of a bag. In the lateral bellows, it serves to connect together four thicknesses of film (the two main faces and the lateral bellows) and between the bellows it connects together two thicknesses of film (corresponding to the main faces).

The other transverse line of heat-sealing 182 is made between the transverse edges 156,158 and 166,168 of the cutouts. This transverse line of heat-sealing 182 is designed to form the mouth of a bag. It interconnects the two main faces.

Once the lines of heat-sealing 180 and 182 have been made, a transverse rectilinear line of cut 181 can be formed between them to separate two adjacent bags.

The lines of heat-sealing 184 and 186 are respectively made up of pairs of segments 184,184*b* and 186*a*,186*b* respectively covering the longitudinal edges 152,154 and 162, 164 and also the transverse edges 158 and 168 of the cutouts.

In this way, the lines of heat-sealing 184,182, and 186 intersect, thereby ensuring that the mouth of the bag is properly sealed. More precisely, the segments 184*a* and 186*a* connect together the outside edges of the two main faces of the bag, while the segments 184*b* and 186*b* connect together the edges 158*a*,158*b* and the edges 168*a*,168*b*.

The method of the present invention has the fundamental advantage of limiting the lines of heat-sealing 184, 182, and 186 to two thicknesses of film, in particular where the closure strips 170 are fixed thereto, whereas most conventional methods need to perform heat-sealing through four thicknesses of film at the lateral bellows.

Naturally, the present invention is not limited to the embodiment described above, but extends to any variant coming within the spirit thereof.

For example, it is possible to make bags using a film of the type shown in FIG. 7 having cutouts 150, 160 and closure strips 170, without applying the film to a form, fill, and seal machine as mentioned above. The film can then be shaped to have a tubular state by any appropriate conventional means.

In the context of the present invention, the film 100 can be varied in numerous ways. It is preferably constituted by a thermoplastic film. Nevertheless, the invention applies to any flexible film that can be used for making a packaging bag.

Furthermore, the person skilled in the art will understand that although, in the example shown in FIG. 5, the longitudinal edges 152,154,162, and 164 of the cutouts 150 and 160 coincide with the fold lines 111,115,121, and 125 so that the lines of heat-sealing 184*a* and 186*a* are made on two thicknesses of film, when the longitudinal edges 152,154, 162, and 164 of the cutouts 150 and 160 are set back from the fold lines 111,115,121, and 125, then the lines of heat-sealing 184*a* and 186*a* are made, at least in part, on four superposed thicknesses of film. The same applies for end portions of the transverse lines of heat-sealing 180 and 182. The lines of heat-sealing 184*a* and 186*a* may also be made at least in part so as to be set back from the fold lines 111,115,121, and 125 as shown in FIG. 9. The variant embodiment of the cutouts as shown in FIG. 5*a* makes it possible to improve the lateral sealing of the bags.

Obviously, many modifications and variations of the present invention are possible in light of the above teachings. It is therefore to be understood that within the scope of the appended claims, the present invention may be practiced otherwise than as specifically described herein.

What is claimed is:

1. A machine for manufacturing packaging bags from packaging bag sheets, comprising:

means for feeding a packaging bag sheet having a longitudinal extent;

means for folding said packaging bag sheet so as to form a pair of laterally spaced bellow regions within side edge portions of said packaging bag sheet;

means for forming cutouts within each one of said pair of laterally spaced bellow regions of said packaging bag sheet so that said packaging bag has only two sheet thicknesses superimposed with respect to each other within a mouth region of said packaging bag, wherein each one of said cut-out portions is defined by two rectilinear longitudinal edges coinciding respectively with outer definition lines of said laterally spaced bellow regions, a first rectilinear transverse edge extending transversely with respect to said longitudinal extent of said packaging bag sheet, and a second non-rectilinear transverse edge that is concave towards said mouth region of said packaging bag; and means for heat sealing together edge portions of said packaging bag sheet to edge portions of said cutouts so as to close and seal said packaging bag.

2. A machine according to claim 1, further comprising:

means for feeding said packaging bag sheet in a direction parallel to said longitudinal extent of said packaging bag sheet; and means for forming said pair of laterally spaced bellow regions so as to comprise a pair of Z-folds which extend parallel to said longitudinal extent of said packaging bag sheet.

3. A machine according to claim 2, wherein:

said means for forming said pair of laterally spaced bellow regions comprising said pair of Z-folds comprises a pair of blades that are partially superimposed with respect to each other so as to partially overlap each other and thereby form a baffle into which said packaging bag sheet is engaged so as to form said pair of Z-folds.

4. A machine according to claim 3, further comprising:

a cut-out punch; and one of said pair of fold-forming blades comprises an anvil for said cut-out punch when said cut-out punch is used to said cut-outs so as to leave one of the faces of said packaging bag sheet intact.

5. A machine according to claim 1, wherein:

said machine comprises a form, fill, and seal machine.

6. A machine according to claim 5, wherein said form, fill, and seal machine comprises:

a forming throat having an inlet for said packaging bag sheet in a substantially planar state, and an outlet for delivering said packaging bag sheet outwardly from said forming throat of said form, fill, and seal machine in the shape of a tube;

a filling chute which opens out into said forming throat and consequently into said tube so as to deposit material into said tube;

first longitudinal heat-sealing means for closing and sealing said tube longitudinally; and second transverse heat-sealing means for sequentially generating transverse lines of heat-sealing so as to close and seal said tube transversely and thereby form said packaging bag.

7. A machine according to claim 1, further:

means for placing transversely oriented complementary male and female closure strips upon said packaging bag sheet within the vicinity of said mouth region of said packaging bag such that said closure strips extend transversely with respect to said longitudinal extent of said packaging bag sheet.

8. A machine according to claim 7, further comprising:

means for initially securing said closure strips in position upon said packaging bag sheet by spot heat-sealing end portions of said closure strips to said packaging bag sheet.

9. A machine according to claim 2, further comprising:

means for fixing said Z-folds by spot heat-sealing said Z-folds at zones wherein transverse lines of heat-sealing are formed so as to close and seal said packaging bag.

10. A machine according to claim 9, further comprising:

heat-sealing means for forming two mutually parallel transverse lines of heat-sealing wherein a first one of said two mutually paralel transverse lines of heat-sealing coincides with said first rectilinear transverse edge of each one of said cutouts so as to form the bottom of said packaging bag, while a second one of said two mutually parallel transverse lines of heat-sealing is formed between said first rectilinear and second non-rectilinear transverse edges of said cutouts so as to form said mouth of said packaging bag; and heat-sealing means for forming additional heat-sealing lines along said longitudinal edges of said cutouts and along said second non-rectilinear transverse edges of said cutouts.

11. A machine according to claim 10, further comprising:

means for forming a rectilinear cut line between said two mutually parallel transverse lines of heat-sealing so as to facilitate separation of formed packaging bags into separate adjacent packaging bags.

12. A machine for manufacturing packaging bags from packaging bag sheets, comprising:

means for feeding a packaging bag sheet having a longitudinal extent;

means for folding said packaging bag sheet so as to form a pair of laterally spaced bellow regions within side edge portions of said packaging bag sheet;

means for forming cutouts within each one of said pair of laterally spaced bellow regions of said packaging bag sheet so that said packaging bag has only two sheet thicknesses superimposed with respect to each other within a mouth region of said packaging bag, wherein each one of said cut-out portions is defined by two rectilinear longitudinal edges which are respectively set back from outer definition lines of said laterally spaced bellow regions, a first rectilinear transverse edge extending transversely with respect to said longitudinal extent of said packaging bag sheet, and a second non-rectilinear transverse edge that is concave towards said mouth region of said packaging bag; and means for heat sealing together edge portions of said packaging bag sheet to edge portions of said cutouts so as to close and seal said packaging bag.

13. A machine according to claim 12, further comprising:

means for feeding said packaging bag sheet in a direction parallel to said longitudinal extent of said packaging bag sheet; and means for forming said pair of laterally spaced bellow regions so as to comprise a pair of Z-folds which extend parallel to said longitudinal extent of said packaging bag sheet.

14. A machine according to claim 13, wherein:

said means for forming said pair of laterally spaced bellow regions comprising said pair of Z-folds comprises a pair of blades that are partially superimposed with respect to each other so as to partially overlap each other and thereby form a baffle into which said packaging bag sheet is engaged so as to form said pair of Z-folds.

15. A machine according to claim 14, further comprising:

a cut-out punch; and one of said pair of fold-forming blades comprises an anvil for said cut-out punch when said cut-out punch is used to said cut-outs so as to leave one of the faces of said packaging bag sheet intact.

16. A machine according to claim 12, wherein:

said machine comprises a form, fill, and seal machine.

17. A machine according to claim 16, wherein said form, fill, and seal machine comprises:

a forming throat having an inlet for said packaging bag sheet in a substantially planar state, and an outlet for delivering said packaging bag sheet outwardly from said forming throat of said form, fill, and seal machine in the shape of a tube;

a filling chute which opens out into said forming throat and consequently into said tube so as to deposit material into said tube;

first longitudinal heat-sealing means for closing and sealing said tube longitudinally; and second transverse heat-sealing means for sequentially generating transverse lines of heat-sealing so as to close and seal said tube transversely and thereby form said packaging bag.

18. A machine according to claim 12, further:

means for placing transversely oriented complementary male and female closure strips upon said packaging bag sheet within the vicinity of said mouth region of said packaging bag such that said closure strips extend transversely with respect to said longitudinal extent of said packaging bag sheet.

19. A machine according to claim 18, further comprising:

means for initially securing said closure strips in position upon said packaging bag sheet by spot heat-sealing end portions of said closure strips to said packaging bag sheet.

20. A machine according to claim 13, further comprising:

means for fixing said Z-folds by spot heat-sealing said Z-folds at zones wherein transverse lines of heat-sealing are formed so as to close and seal said packaging bag.

21. A machine according to claim 20, further comprising:

heat-sealing means for forming two mutually parallel transverse lines of heat-sealing wherein a first one of said two mutually paralel transverse lines of heat-sealing coincides with said first rectilinear transverse edge of each one of said cutouts so as to form the bottom of said packaging bag, while a second one of said two mutually parallel transverse lines of heat-sealing is formed between said first rectilinear and second non-rectilinear transverse edges of said cutouts so as to form said mouth of said packaging bag; and heat-sealing means for forming additional heat-sealing lines along said longitudinal edges of said cutouts and along said second non-rectilinear transverse edges of said cutouts.

22. A machine according to claim 21, further comprising:

means for forming a rectilinear cut line between said two mutually parallel transverse lines of heat-sealing so as to facilitate separation of formed packaging bags into separate adjacent packaging bags.

* * * * *